US007317424B2

(12) United States Patent
Onishi et al.

(10) Patent No.: US 7,317,424 B2
(45) Date of Patent: Jan. 8, 2008

(54) VEHICLE ANTENNA DEVICE HAVING HIGH POWER FEEDING RELIABILITY

(75) Inventors: Tadaaki Onishi, Fukushima-ken (JP); Tomotaka Suzuki, Fukushima-ken (JP); Tomoki Ikeda, Fukushima-ken (JP)

(73) Assignee: ALPS Electric Co., Ltd., Ota-Ku, Tokyo (JP)

( * ) Notice: Subject to any disclaimer, the term of this patent is extended or adjusted under 35 U.S.C. 154(b) by 29 days.

(21) Appl. No.: 11/451,733

(22) Filed: Jun. 12, 2006

(65) Prior Publication Data

US 2007/0052601 A1 Mar. 8, 2007

(30) Foreign Application Priority Data

Sep. 6, 2005 (JP) ..... 2005-257860

(51) Int. Cl.
*H01Q 1/32* (2006.01)

(52) U.S. Cl. ..... 343/713; 343/795

(58) Field of Classification Search ..... 343/711, 343/700 MS, 713, 795
See application file for complete search history.

(56) References Cited

U.S. PATENT DOCUMENTS 5,363,114 A 11/1994 Shoemaker ..... 343/828
6,975,272 B2 * 12/2005 Yuanzhu ..... 343/700 MS
7,119,745 B2 * 10/2006 Gaucher et al. ..... 343/700 MS
7,193,576 B2 * 3/2007 Yazdandoost et al. ..... 343/767
2003/0176095 A1 9/2003 Feder et al. ..... 439/271
2007/0040756 A1 * 2/2007 Song et al. ..... 343/713

FOREIGN PATENT DOCUMENTS

DE 20210286 U1 7/2002
JP 2000-196327 7/2000

OTHER PUBLICATIONS

G. Trogisch, "Flexible Leiterplatten im Aufwind," Nov. 1, 1989, Feinwerktechnik & Messtechnik, vol. 97, No. 11, pp. 485-488.
European Search Report dated Dec. 29, 2006, from corresponding European Application No. 06016846.5-1248.

* cited by examiner

*Primary Examiner*—Tan Ho
(74) *Attorney, Agent, or Firm*—Beyer Weaver LLP

(57) ABSTRACT

There is provided a vehicle antenna device having a high connection reliability and mounted simply. A vehicle antenna device comprise a film antenna unit 1 in which an emission conductor pattern 3 is formed on a resin film 2 and a power feeding terminal 4 is exposed to a tongue part 2*a;* an insulating casing 6 having slits 6*a* and 6*b* for inserting the tongue part 2*a* and an opening 6*c* for inserting a coaxial cable 20, and installed in the vicinity of the film antenna unit 1; and a circuit substrate 7 which is housed and retained within the casing 6, and connected to the power feeding terminal 4 and the coaxial cable 20, wherein the tongue part is loaded within the casing 6 by passing the tongue part 2*a* through any one of both slits 6*a* and 6*b,* and a an electrode pin 9 connected electro-mechanically to the circuit substrate 7 is pressure-contacted to the power feeding terminal 4 within the casing 6.

5 Claims, 3 Drawing Sheets

VEHICLE ANTENNA DEVICE HAVING HIGH POWER FEEDING RELIABILITY

FIELD OF THE INVENTION

The present invention relates to a vehicle antenna device suitable to be mounted on a front glass or a rear window of a vehicle, in which an emission conductor pattern is formed on a film face.

DESCRIPTION OF THE RELATED ART

Generally, this kind of vehicle antenna device has a film antenna unit in which an emission conductor pattern or a power feeding terminal is formed on a resin film and a connector circuitry unit incorporating, and a circuit substrate on which a low-noise amplifying circuit and the like are formed. The power feeding terminal in the film antenna unit is electrically connected to a signal cable such as a coaxial cable via the circuit substrate of the connector circuitry unit. That is, since good antenna performance can be expected by attaching the film antenna unit on a rear window or the like of a vehicle, if the power feeding terminal and the signal cable are connected to the circuit substrate by installing the connector circuitry unit in the vicinity of the film antenna unit, an external circuit such as a receiving circuit can be electrically connected to the power feeding terminal of the film antenna unit via the signal cable, so that a vehicle antenna device having a high practical value can be provided.

As a prior art of this vehicle antenna device, there has been known a configuration that a tip portion of a conductive elastic piece is in contact with the power feeding terminal of the film antenna unit via a window part of a casing by establishing the window part on the casing and retaining the circuit substrate of the connector circuitry unit and connecting a rear anchor portion of the conductive elastic piece to the circuit substrate. (for example, referring to JP-A-2000-196327 (Page No. 3 to 4, and FIG. 2)) In such a prior art, in a step preceding an electrical connection of the connector circuitry unit and the film antenna unit, the tip portion of the conductive elastic piece is protruded from the window portion of a casing to an outward, the film antenna unit is attached onto a glass surface of a mounting object. The conductive elastic piece is aligned with the power feeding terminal exposed to one corner of the film antenna unit, and a casing of the connector circuitry unit is attached onto a vicinity of the film antenna unit, so that the conductive elastic piece is pushed down and bent in a pressure-contacted state. In addition, an opening is formed on a side opposite to a side on which the film antenna unit keeps in the connector circuitry unit and one end of the signal cable (coaxial cable) is inserted into this opening, thereby being connected to the circuit substrate.

In the conventional vehicle antenna device described above, upon mounting the connector circuitry unit, since the casing is attached onto the power feeding terminal of the film antenna unit previously attached onto the glass surface by pushing down and bending the conductive elastic piece, if an elastic repulsive force generated from the conductive elastic piece is very strong, the casing can be easily peeled off by the elastic repulsive force. For this reason, the elastic repulsive force generated from the conductive elastic piece is set to be relatively weak, thus, since a contact pressure of the conductive elastic piece to the power feeding terminal becomes insufficient, it was difficult to achieve the high reliability.

In addition, in such a prior antenna device, in casing that a mounting position of the casing after the attachment is slightly dislocated by an external force, since a contact failure may easily occur between the conductive elastic piece and the power feeding terminal, it was difficult to achieve the high reliability.

Moreover, in such a prior antenna device, since the vicinity of the window portion of the casing is not the mounting surface, and a gap is formed between the vicinity of the window portion and the mounting object such as the glass surface, impurities are intruded from the external space and a conduction failure or a short circuit accident may be induced if the gap is not sealed with an adhesive agent. Therefore, to evade the lowering of the reliability caused by the intrusion of the impurities, a complicated sealing work for sealing the gap with the adhesive agent is required.

Further, generally, in this kind of vehicle antenna device, even though the opening of the connector circuitry unit into which one end of the signal cable is inserted is formed on a side opposite to a side on which the film antenna unit keeps, in casing that the connector circuitry unit having such a configuration is connected with a dipole antenna having a relatively long half-wavelength, the signal cable is required to be wired by bending substantially orthogonally on the way so that the signal cable is extended along a longitudinal direction of the film antenna unit. However, if the signal cable is wired by folding and bending substantially orthogonally, an excessive stress is applied to a signal line, to easily cause a transmission failure, so that the wiring work becomes complicated.

SUMMARY OF THE INVENTION

An object of the present invention is to provide a vehicle antenna device having a high connection reliability and mounted simply in view of an actual condition of the prior art.

In order to achieve the object, there is provided a vehicle antenna device comprising a film antenna unit in which an emission conductor pattern is formed on a resin film and a power feeding terminal of the emission conductor pattern is exposed to a tongue part of the resin film; an insulating casing having a slit for inserting the tongue part and an opening for inserting one end of a signal cable, and installed in the vicinity of the film antenna unit; and a circuit substrate which is housed and retained within the casing, and connected to the power feeding terminal and the signal cable, wherein the tongue part is loaded within the casing via the slit and a conductive protrusion connected electrically and mechanically to the circuit substrate is pressure-contacted to the power feeding terminal within the casing.

As described above, in the vehicle antenna device, since the tongue part of the resin film is loaded within the casing installed in the vicinity of the film antenna unit, the electrode pin attached onto the circuit substrate can be pressure-contacted within the casing. As a result, the contact pressure between the electrode pin and the feeding terminal can be sufficiently raised without giving a harmful effect to the mounting strength, and in addition, even though the mounting position of the casing is slightly dislocated by an external force, since the contact failure between the electrode pin and the power feeding terminal is difficult to occur, the contact reliability is remarkably improved. In addition, since the tongue part is disposed within the casing by passing a slit, a part of a path which reaches from an external space to the power feeding terminal is limited only to a fine gap which is not occupied by the tongue part 2*a* within the slit, whereby the penetration of impurities from the external space can be effectively prevented without performing a complicated sealing work.

By this configuration, if an elastic supporting member onto which the tongue part is loaded is provided within the casing and the conductive protrusion is contacted to the power feeding terminal exposed to a face opposite to a loading face of the tongue part by providing an elastic supporting member onto which the tongue part is loaded within the casing, the contact pressure can be easily raised. In this casing, if the conductive protrusion is an electrode pin and a head part of the electrode pin is pressure-contacted to the power feeding terminal by holding the tongue part between the head part and the elastic supporting member, the electrode pin and the power feeding terminal can be stably contacted.

In addition, by this configuration, the casing includes a lower casing for supporting the tongue part and a upper casing for gating a upper opening of the lower casing, and the tongue part is latched to the lower casing in a positioning state by inserting a positioning pin protruded on an inner bottom portion of the lower casing into a through-hole formed on the tongue part, the tongue part can be easily incorporated in a tube and the position accuracy of the power feeding terminal can be easily raised.

In addition, by this configuration, in casing the diversity antenna is configured by a pair of film antenna units on a left face and a right face of the mounting object, the film antenna unit is a half-wavelength dipole antenna, and the tongue part is protruded on one side of a longitudinal middle portion of the resin film and the slits are provided on both sides of the casing opposite to each other, respectively, whereby the tongue part can be selectively inserted into any one of both slits thereof.

In the vehicle antenna device of the present invention, since the tongue part of the resin film is loaded within the casing installed in the vicinity of the film antenna unit, the electrode pin attached onto the circuit substrate can be pressure-contacted within the casing. As a result, the contact pressure between the electrode pin and the feeding terminal can be sufficiently raised without giving a harmful effect to the mounting strength, and in addition, even though the mounting position of the casing is slightly dislocated by an external force, since the contact failure between the electrode pin and the power feeding terminal is difficult to occur, the contact reliability is remarkably improved. In addition, since the tongue part is disposed within the casing by passing a slit, a part of a path which reaches from an external space to the power feeding terminal is limited only to a fine gap which is not occupied by the tongue part 2*a* within the slit, whereby the penetration of impurities from the external space can be effectively prevented without performing a complicated sealing work.

In the vehicle antenna device, since the tongue part of the resin film is loaded within the casing provided in the vicinity of the film antenna unit and the conductive protrusion attached on the circuit substrate is pressure-welded to the power feeding terminal within the casing, even though the contact pressure between the conductive protrusion and the power feeding terminal is sufficiently increased, a harmful effect is not given to the mounting strength of the casing. Even though the mounting position of the casing 6 is slightly displaced by an external force, since the contacting between the conductive protrusion and the power feeding terminal can be easily maintained, the contact reliability is remarkably improved. In addition, since the tongue part of the resin film is disposed within the casing via the slit. A part of a path from an external space of the casing to the power feeding terminal is limited only to a fine gap which is not occupied by the tongue part within the slit. Therefore, the penetration of impurities from the external space can be effectively prevented without performing a complicated sealing work.

BEST MODE FOR CARRYING OUT THE INVENTION

Figure 1:
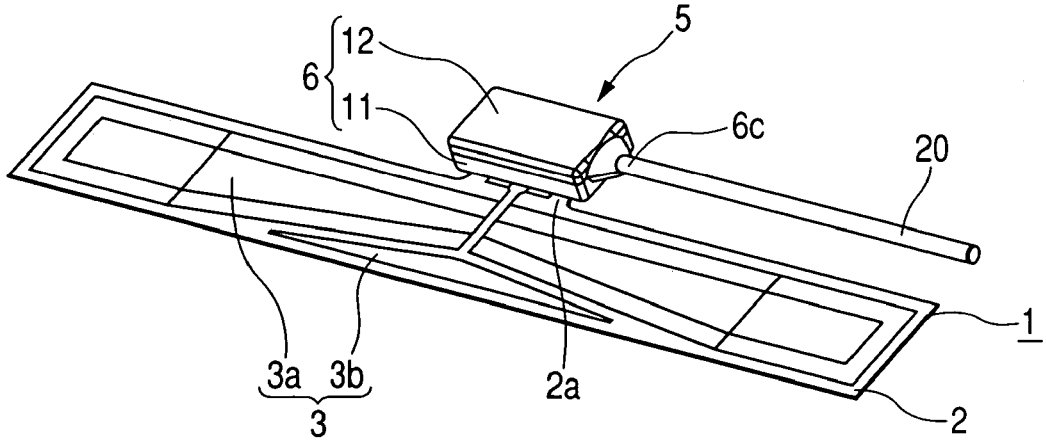
FIG. 1 is an external view of a vehicle antenna device according to an embodiment of the present invention.
Figure 2:
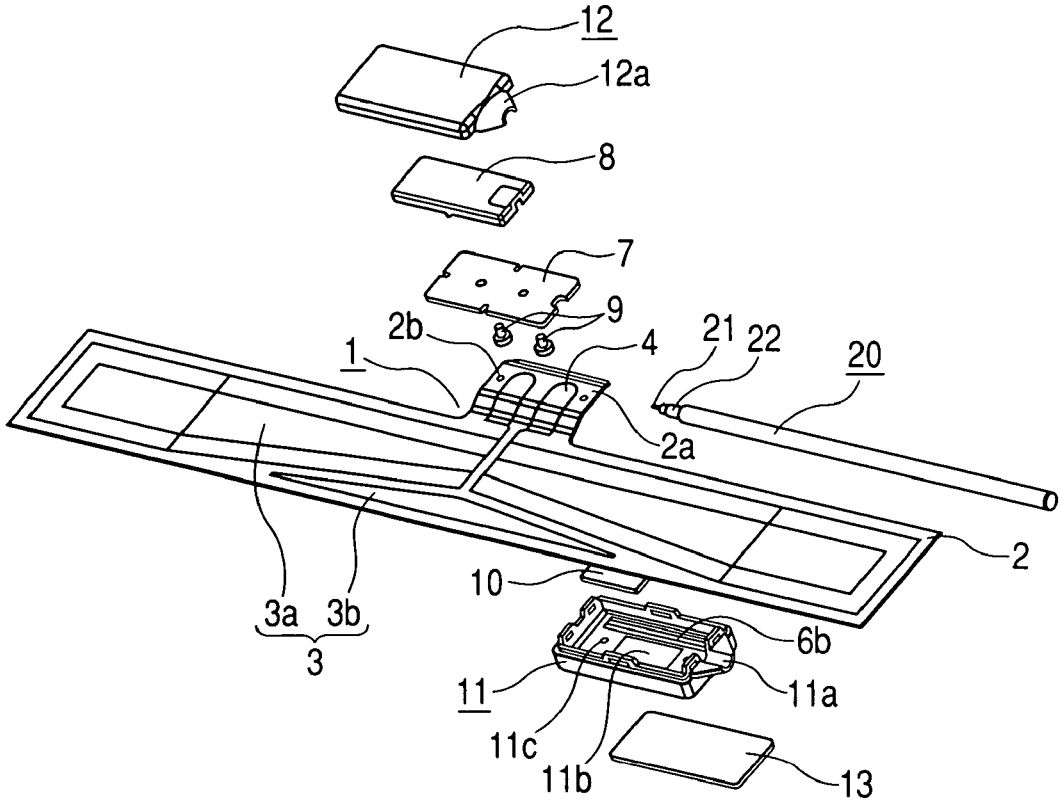
FIG. 2 is a perspective view of an antenna device.
Figure 3:
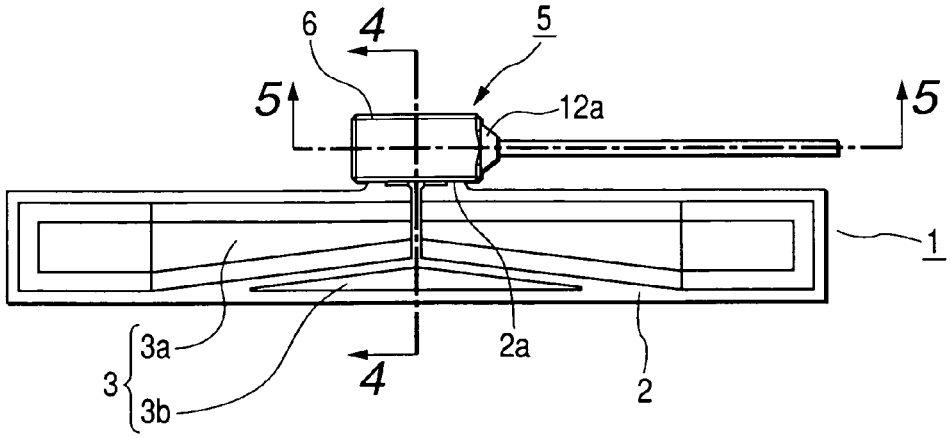
FIG. 3 is a front view of an antenna device.
Figure 4:
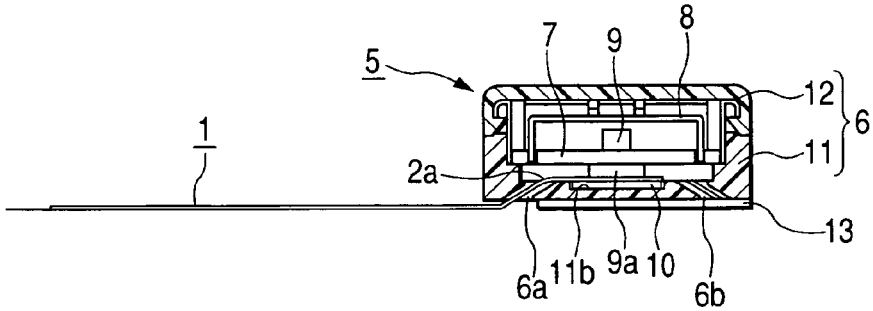
FIG. 4 is a cross-sectional view taken along line A-A shown in FIG. 3.
Figure 5:
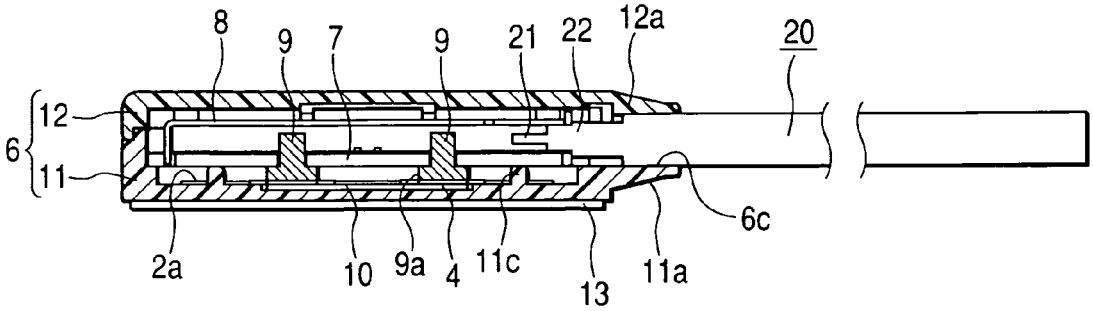
FIG. 5 is a cross-sectional view taken along line B-B shown in FIG. 3.
Figure 6:
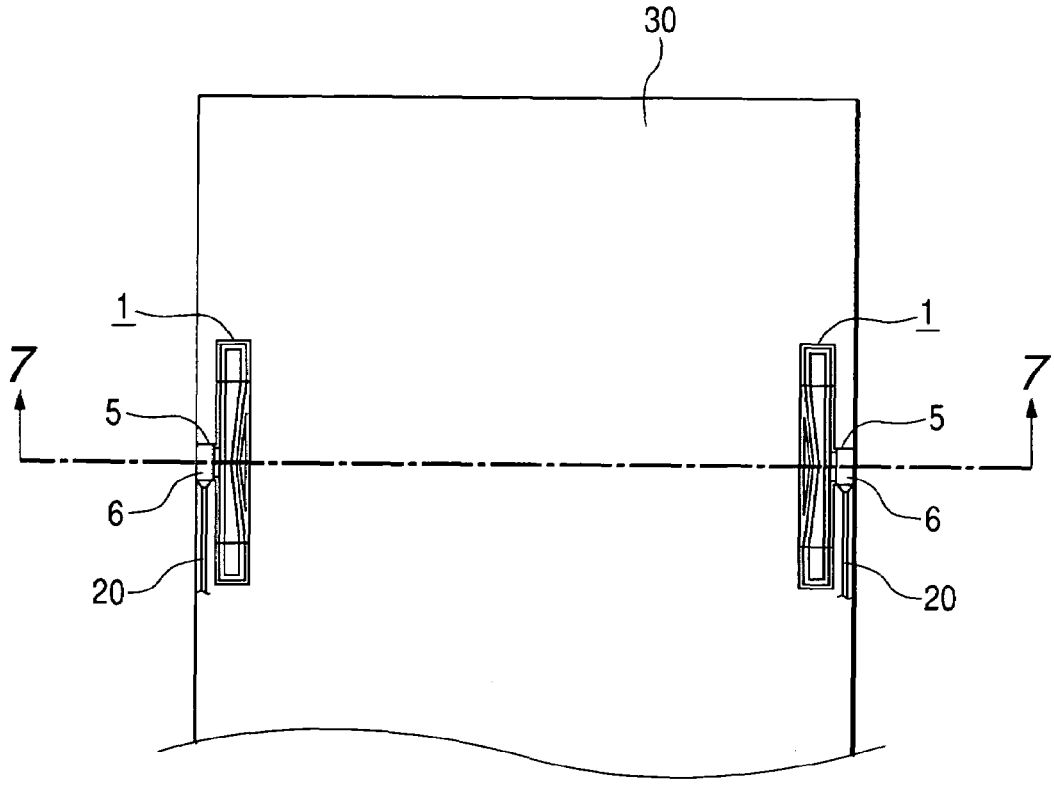
FIG. 6 is a front view of a diversity antenna using an antenna device.
Figure 7:
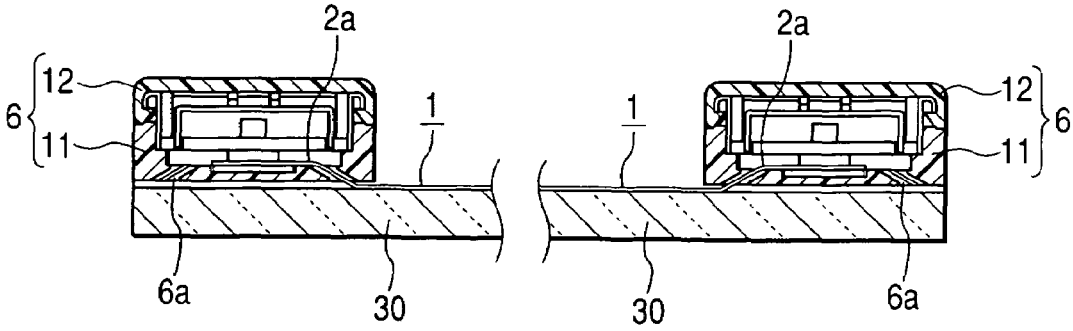
FIG. 7 is a cross-sectional view of a main part taken along line C-C shown in FIG. 6.

An embodiment of the present invention will be described with reference to the drawings. FIG. 1 is an external view of a vehicle antenna device according to the embodiment of the present invention. FIG. 2 is an exploded perspective view of the antenna device. FIG. 3 is a front view of the antenna device. FIG. 4 is a cross-sectional view taken along a line A-A shown in FIG. 3. FIG. 5 is a cross-sectional view taken along a line B-B shown in FIG. 3. FIG. 6 is a front view of a diversity antenna using the antenna device. FIG. 7 is a cross-sectional view of a main part take along a line C-C.

Since the vehicle antenna device shown in FIGS. 1 to 5 has a film antenna unit 1 in which an emission conductor pattern 3 and a power feeding terminal 4 are formed on a resin film and, and a connector circuitry unit in which a circuit substrate (LNA substrate) 7 and a shield casing 8 are placed within a rectangular casing 6 as viewed planarly. A head portion 9*a* of an electrode pin 9 attached on the circuitry substrate 7 is pressure-contacted to the power feeding terminal 4 of the film antenna unit 1 within the casing 6 and one end of a coaxial cable (signal cable) 20 is connected to the circuit substrate 7 and the shield casing 8 within the casing 6. As shown in FIG. 6, the vehicle antenna devices are mounted onto a right end and a left end of a vehicle rear window 30 (or vehicle front glass), respectively, to constitute the diversity antenna.

The film antenna unit 1 is a half-wavelength dipole antenna of central power feeding type. The emission conductor pattern 3 is formed on the long strip-shaped resin film 2 and a tongue part 2*a* is protruded on one side at a longitudinal middle portion of the resin film 2. A pair of power feeding terminals 4 is formed on the tongue part 2*a*. Moreover, although not clearly stated in particular, the emission conductor pattern 3 is coated by a protection layer and the power feeding terminal 4 is exposed at a portion conducted to the electrode pin 9. In addition, positioning through-holes 2*b* are formed at two locations which do not overlap with the power feeding terminals 4 in the tongue part 2. The emission conductor pattern 3 includes a long main emission conductor part 3*a* to which power is directly fed by the power feeding terminal 4 and a sub emission conductor part 3*b* to which power is indirectly fed via the main emission conductor part 3*a*. A longitudinal middle portion of the main emission conductor part 3*a* is connected to the power feeding terminal 4. If the main emission conductor part 3*a* is resonated by the power feeding from the power feeding terminal 4, the sub emission conductor part 3*b* is resonated at a slightly different frequency, whereby it is possible to operate as a dipole antenna having a wide bandwidth.

The connector circuitry unit 5 comprises an insulating casing 6 in which a first slit 6*a*, a second slit 6*b* and an opening 6 care formed, a circuitry substrate 7 on which a low-noise amplifying circuit and the like are formed, a shield casing 8 electro-magnetically shielding electronic parts such as an amplifier and provided vertically on the circuit substrate 7, a pair of electrode pins 9 electrically and mechanically connected to the circuit substrate 7, and a planar cushion member 10 made of elastic resin.

The casing 6 comprises a lower casing 11 having a recess 11*b* for mounting the cushion member 10 at a center of an inside bottom part, and the first and second slits 6*a* and 6*b* on both sides of the recess 11*b*, and an upper casing 12 for covering an upper opening of the lower casing 11. Both casings 11 and 12 are integrated by suitable means such as snap fitting. A longitudinal direction of the casing 6 is set to be substantially parallel to a longitudinal direction of the film antenna unit 1. The opening 6*c* is defined on one longitudinal end (that is, one short edge side) of the casing 6 by an extending portion 11*a* of the lower casing 11 and an extending portion 12*a* of the upper casing 12. In addition, positioning pins 11*c* are protruded on two locations of an inner bottom portion of the lower casing 11. The tongue part 2*a* drawn into the casing 6 is loaded on the lower casing 11 in a positioning state by inserting these positioning pins 11*c* into the through-hole 2*b* formed in the tongue part 2*a* of the film antenna unit 1, whereby a pair of power feeding terminals 4 is exposed on a face opposite to a loading face of the tongue part 2*a*.

That is, after the cushion member 10 is mounted within the recess 11*b* of the lower casing 11, if the positioning pin 11*c* is inserted into the through-hole 2*b* of the tongue part 2*a* having been passed through the first slit 6*a* or the second slit 6*b*, the tongue part 2*a* is latched to the lower casing 11 in a state that each power feeding terminal 4 is mounted on the cushion member 10. Then, if the circuit substrate 7 on which the shield casing 8 and each electrode pin 9 are fixed is incorporated in an upper end of the lower casing 11 and the upper casing 12 is attached onto the lower casing 11, a head part 9*a* of each electrode pin 9 is pressure-contacted corresponding power feeding terminal 4 and the emission conductor pattern 3 is electrically connected to the circuit substrate 7. In addition, before the upper casing 12 is attached onto the lower casing 11 by electrically connecting an internal conductor 21 and an external conductor 22 on one end of the coaxial cable 20 to the circuit substrate 7 and the shield casing 8, respectively, the coaxial cable 20 conducted from the external circuit can be electrically connected to the power feeding terminal 4 of the film antenna unit 1 via the circuit substrate 7. By this configuration, the power feeding to the power feeding terminal 4 can be performed and a signal received to the emission conductor pattern 3 can be amplified and transmitted to the coaxial cable 20 by the circuit substrate 7.

Moreover, even though a double-faced adhesive tape 13 by attaching the double-faced adhesive tape 13 is provided onto a bottom face of the lower casing 11 and the casing 6 can be attached onto a desired position of an installation object such as a glass face by means of a double-faced adhesive tape 13, since the casing 6 is required to be attached to a position where the tongue part 2*a* keeps in the vicinity of the film antenna unit 1, the casing 6 is linearly designed along a line B-B of FIG. 3 in this embodiment. By this configuration, any one of the first slit 6*a* and the second slit 6*b* is selected, the tongue part 2*a* can be loaded on the cushion member 10 within the casing 6. The unused slit 6*a* or 6*b* is covered by the double-faced adhesive tape 13, as shown in FIG. 4.

That is, in a diversity antenna shown in FIG. 6, since it is preferable that the coaxial cable 20 can be dragged downward along both the right end and the left end of a rear window 30, the protrusion direction of the tongue parts 2*a* is set to be a direction reverse to each other, in the right and left antenna films 1. Therefore, in this embodiment, in the connector circuitry unit 5 connected to the right film antenna unit 1 shown in FIG. 6, the casing 6 is disposed in the vicinity of the right end of the rear window 30 by inserting the tongue part 2*a* into the first slit 6*a* similar to FIGS. 1 to 5, and the coaxial cable 20 is straightly dragged downward. In the connector circuitry unit 5 connected to the left film antenna unit 1 shown in FIG. 6, the casing 6 is disposed in the vicinity of the left end of the rear window 30 by inserting the tongue part 2*a* into the second slit 6*b*, and the coaxial cable 20 is straightly dragged downward.

As described above, in the vehicle antenna device according to this embodiment, since the tongue part 2*a* of the resin film 2 is loaded within the casing 6 installed in the vicinity of the film antenna unit 1, the electrode pin 9 attached onto the circuit substrate 7 can be pressure-contacted to the power feeding terminal 4 within the casing 6. As a result, the contact pressure between the electrode pin 9 and the feeding terminal 4 can be sufficiently raised without giving a harmful effect to the mounting strength of the casing 6. Even though the mounting position of the casing 6 is slightly displaced by an external force, since the contact failure between the electrode pin 9 and the power feeding terminal 4 is difficult to occur, the contact reliability is remarkably improved. In addition, since the tongue part 2*a* is disposed within the casing 6 by passing the first slit 6*a* (or the second slit 6*b*), a part of a path from an external space of the casing 6 to the power feeding terminal 4 is limited only to a fine gap which is not occupied by the tongue part 2*a* within the first slit 6*a* (or the second slit 6*b*). Therefore, the penetration of impurities from the external space can be effectively prevented without performing a complicated sealing work.

In addition, in the vehicle antenna device according to this embodiment, since the cushion member 10 onto which the tongue part 2*a* is provided within the casing 6 and the head part 9*a* of the electrode pin 9 is elastically pressure-contacted to the power feeding terminal 4 on the cushion member 10, that is, the tongue part 2*a* is elastically held between the cushion member 10 and the head part 9*a*, the contact pressure between the power feeding terminal 4 and the electrode pin 9 can be easily increased, and both the power feeding terminal 4 and the electrode terminal 9 can be stably contacted. Therefore, the reliability of the connection can be increased.

In addition, in the vehicle antenna device according to this embodiment, since the tongue part 2*a* is latched to the lower casing 11 in a positioning state by protruding the positioning pin 11*c* on the inner bottom portion of the lower casing 11 constituting the casing 6 and inserting the positioning pin 11*c* into the trough-hole 2*b* of the tongue part 2*a*, the tongue part 2*a* can be easily incorporated in the casing 6 and the position accuracy of the power feeding terminal 4 with respect to the circuit substrate 7 can be easily improved.

In addition, in the vehicle antenna device according to this embodiment, the film antenna unit 1 is a half-wavelength dipole antenna. Although, the tongue part 2*a* is protruded on one side of the longitudinal middle portion of the film antenna unit, the first slit 6*a* and the second slit 6*b* are provided on both sides of the casing 6 opposite to each other so that the tongue part 2*a* can be corresponded even though the tongue part 2*a* is protruded in any direction. Since the opening 6*c* for the coaxial cable 20 is provided on one longitudinal end of the casing 6, even though the tongue part 2*a* is protruded in a reverse direction to the film antenna unit 1 similarly to the diversity antenna shown in FIG. 6, the coaxial cable 20 can be straightly dragged along the film antenna unit 1 from the opening 6*c* using he shape of the casing 6. Accordingly, without applying an excessive stress to the signal line, the wiring work of the coaxial cable 20 can be easily performed and the cost-down can be prompted by the standardization of the parts.

Moreover, in the above embodiment, the casing that the electrode pin 9 attached onto the circuit substrate 7 is pressure-contacted to the power feeding terminal 4 is described, but other conductive protrusions (for example, soldering balls) electrically and mechanically connected to the circuit substrate 7 may be pressure-contacted to the power feeding terminal 4 instead of the electrode pin 9.

In addition, in the embodiment above, the casing that the film antenna unit 1 is the half-wavelength dipole antenna, but the present invention can be applied to the casing that the film antenna unit 1 is not the half-wavelength dipole antenna. The point is that the film antenna unit, in which the emission conductor pattern is formed on the resin film and the power feeding terminal of the emission conductor pattern is exposed to the tongue part of the resin film, may be used.

The invention claimed is:

1. A vehicle antenna device, comprising:

a film antenna unit in which an emission conductor pattern is formed on a resin film and a power feeding terminal of the emission conductor pattern is exposed to a tongue part of the resin film;

an insulating casing having a slit for inserting the tongue part and an opening for inserting one end of a signal cable, and installed in the vicinity of the film antenna unit; and a circuit substrate which is housed and retained within the casing, and connected to the power feeding terminal and the signal cable, wherein the tongue part is loaded within the casing via the slit and a conductive protrusion connected electrically and mechanically to the circuit substrate is pressure-contacted to the power feeding terminal within the casing.

2. The vehicle antenna device according to claim 1, wherein an elastic supporting member onto which the tongue part is loaded is provided within the casing and the conductive protrusion is welded to the power feeding terminal exposed to a face opposite to a loading face of the tongue part with pressure by providing an elastic supporting member onto which the tongue part is loaded within the casing.

3. The vehicle antenna device according to claim 2, wherein the conductive protrusion is an electrode pin and a head part of the electrode pin is pressure-contacted to the power feeding terminal by holding the tongue part between the head part and the elastic supporting member.

4. The vehicle antenna device according to claim 1, wherein the casing includes a lower casing for supporting the tongue part and a upper casing for gating a upper opening of the lower casing, and the tongue part is latched to the lower casing in a positioning state by inserting a positioning pin protruded on an inner bottom portion of the lower casing into a through-hole formed on the tongue part.

5. The vehicle antenna device according to claim 1, wherein the film antenna unit is a half-wavelength dipole antenna, and the tongue part is protruded on one side of a longitudinal middle portion of the resin film and the slits are provided on both sides of the casing opposite to each other, respectively, whereby the tongue part can be selectively inserted into any one of both slits thereof.

* * * * *